United States Patent [19]

Kuehn

[11] Patent Number: 4,659,391

[45] Date of Patent: Apr. 21, 1987

[54] METHOD AND APPARATUS FOR REMOVING EXCESS MATERIAL FROM SAND CORES

[75] Inventor: Udo Kuehn, Onsted, Mich.

[73] Assignee: B & U Corporation, Adrian, Mich.

[21] Appl. No.: 717,914

[22] Filed: Mar. 29, 1985

Related U.S. Application Data

[63] Continuation-in-part of Ser. No. 529,260, Sep. 6, 1983, abandoned.

[51] Int. Cl.[4] ..... B24C 3/12; B08B 7/00

[52] U.S. Cl. ..... 134/7; 15/3.5; 15/304; 51/320; 51/418

[58] Field of Search ..... 134/7; 164/5, 401; 51/319, 320, 418; 15/316 R, 304, 3.5

[56] References Cited

U.S. PATENT DOCUMENTS

| | | | |
|---|---|---|---|
| 3,313,067 | 4/1967 | Smith et al. | 51/320 |
| 3,559,344 | 2/1971 | Peterson | 51/319 |
| 3,696,565 | 10/1972 | Claeys | 51/320 |
| 3,854,899 | 12/1974 | Germain et al. | 51/319 |
| 4,115,960 | 9/1978 | Zecher | 51/319 |
| 4,174,591 | 11/1979 | Dupre et al. | 51/418 X |

*Primary Examiner*—Richard V. Fisher
*Assistant Examiner*—W. Gary Jones
*Attorney, Agent, or Firm*—Stephenson and Boller

[57] ABSTRACT

A method and apparatus for removing flash and other excess material from sand cores in which the cores are showered with impact particles of relatively soft material and contained in moving air streams issuing from a plurality of nozzles directed against opposite sides of cores being cleaned. Low pressure air from a blower is used at the nozzles to obtain a high density of particles in the moving air stream and provide for engagement of the particles in a gentle manner with the sand cores so as to minimize surface erosion of the cores.

4 Claims, 6 Drawing Figures

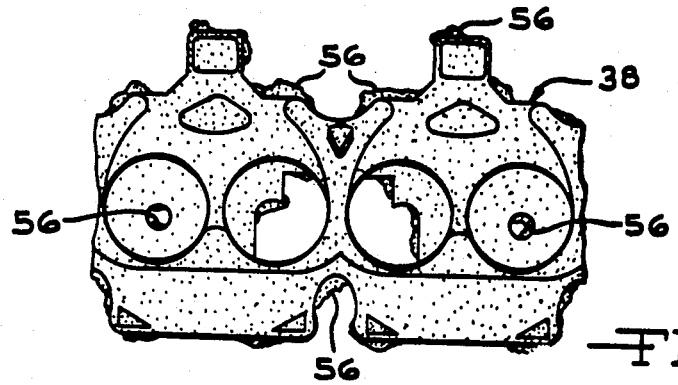
FIG. 4
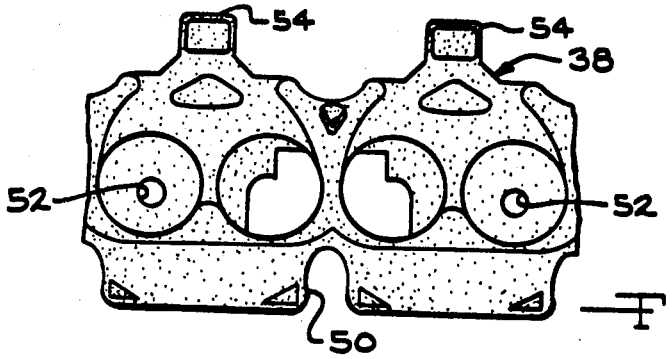
FIG. 5
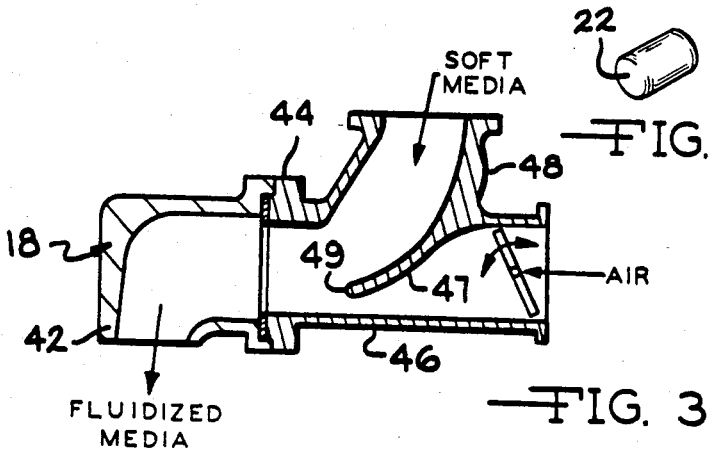
FIG. 6
FIG. 3

METHOD AND APPARATUS FOR REMOVING EXCESS MATERIAL FROM SAND CORES

CROSS REFERENCE TO RELATED APPLICATION

This application is a continuation-in-part of co-pending application Ser. No. 529,260 filed Sept. 6, 1983, now abandoned.

BACKGROUND OF THE INVENTION

This invention relates generally to the art of finishing and cleaning molded articles by directing particulate material against the rough molded article. Impeller systems for directing metal shot against cast metal articles for cleaning the articles is well known. It is also known to de-fin rough cast metal parts, such as engine blocks, by blasting parts with large metal particles. U.S. patent application Ser. No. 382,833 filed May 27, 1982 assigned to the assignee of this application, shows such a de-finning system.

The present invention relates more specifically to the finish cleaning of molded sand cores which are made by molding a mixture of sand and a binder, to form a core that may be of complex shape having holes, projections, notches, and other irregularly shaped areas. Such articles are far more delicate than the articles which have heretofore been finished by blasting with an impact media, often metal particles moving at high velocities. Accordingly, prior art blasting apparatus and methods have not been adaptable to the problem of automated cleaning of molded sand cores, and the present rubbing by hand methods for cleaning cores are unacceptable because they are time consuming and expensive.

It is an object of the present invention, therefore, to provide an improved method and apparatus for removing flash and other excess material from sand cores by directing a fluidized media of impact particles against the sand cores.

SUMMARY OF THE INVENTION

The present invention provides an apparatus and method in which relatively soft impact particles are showered against the cores in a relatively gentle manner so as to remove flash and other excess material without damaging the cores. The apparatus consists of a conveyor on which the relatively light-weight sand cores are supported so that the opposite sides of the cores can be reached by streams of impact particles. A plurality of nozzles are positioned both above and below the conveyor and relatively low pressure air is directed through the nozzles in the direction of the sand cores on the conveyors. Large volumes of relatively soft impact particles without any sharp points or edges, such as small pieces of plastic, are entrained in the air so that they will be directed against the sand cores. The flash and other excess material is relatively loosely adhered or attached to the main body of the core and as a result, when these loosely adhered pieces are impacted by the moving particles, they are dislodged from the main body of the core. However, when these relatively soft slow moving particles engage the sand core, the particles do not damage or disrupt the surface of the main body of the core.

Accordingly, when the sand cores that are on the moving conveyor are exposed to the action of the fluidized impact media for a relatively short time, the flash and other excess material is quickly removed from the cores. As a result, the apparatus can be operated continuously to automatically clean and finish a large number of sand cores in a short time.

The method and apparatus of this invention is advantageous in that it provides for the rapid and thorough cleaning of complex parts by subjecting these parts to showers of particles moving against the parts from different directions so as to finish both internal and external surfaces in the part.

Further objects, features and advantages of this invention will become apparent from a consideration of the following description and the appended claims, when taken in connection with the accompanying drawings in which:

FIG. 3 is a sectional view of one of the nozzles in the apparatus of this invention;

FIG. 4 is a fragmentary top view of a sand core prior to cleaning;

FIG. 5 is a top view of the sand core shown in FIG. 4, after cleaning; and FIG. 6 is a perspective view of an impact particle useable in the method and apparatus of this invention.

Figure 1:
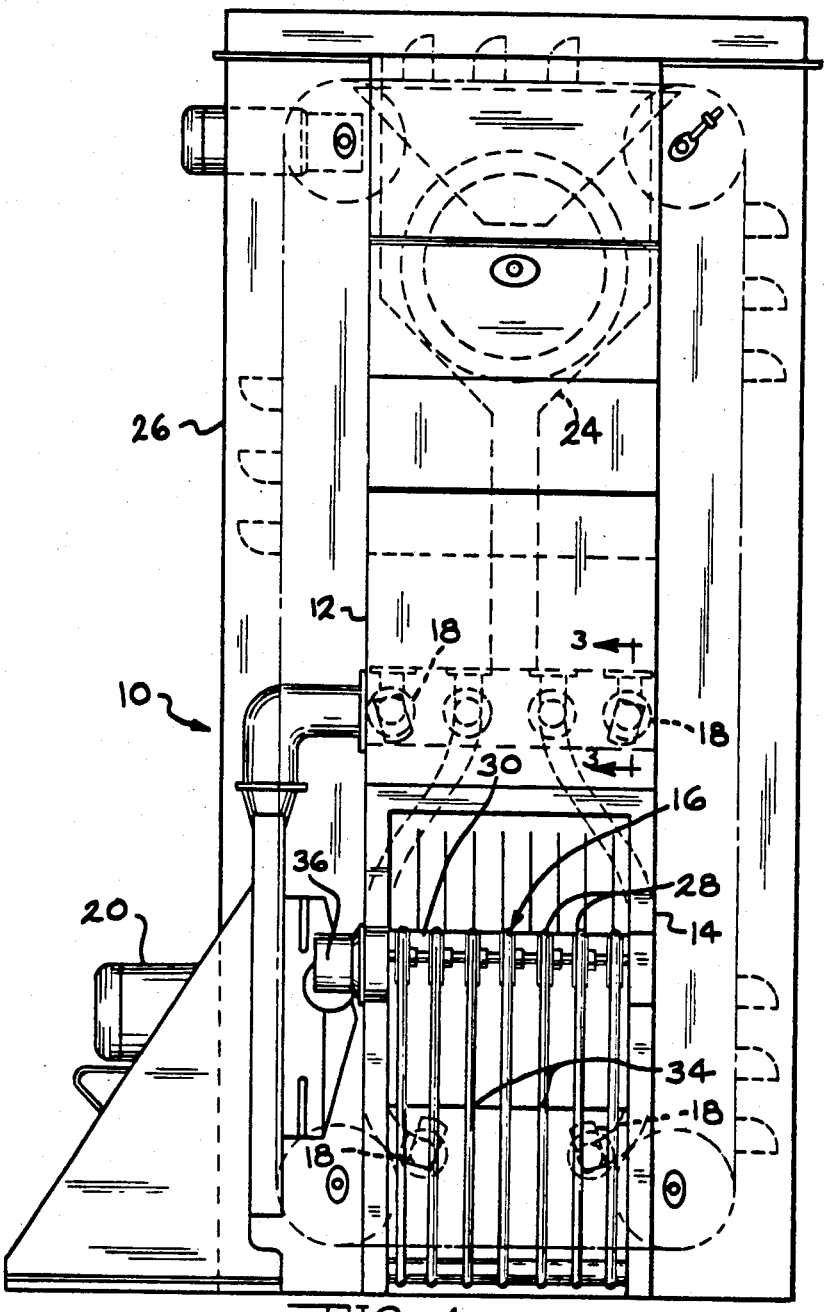
FIG. 1 is an end view of the core de-finning apparatus of this invention.
Figure 2:
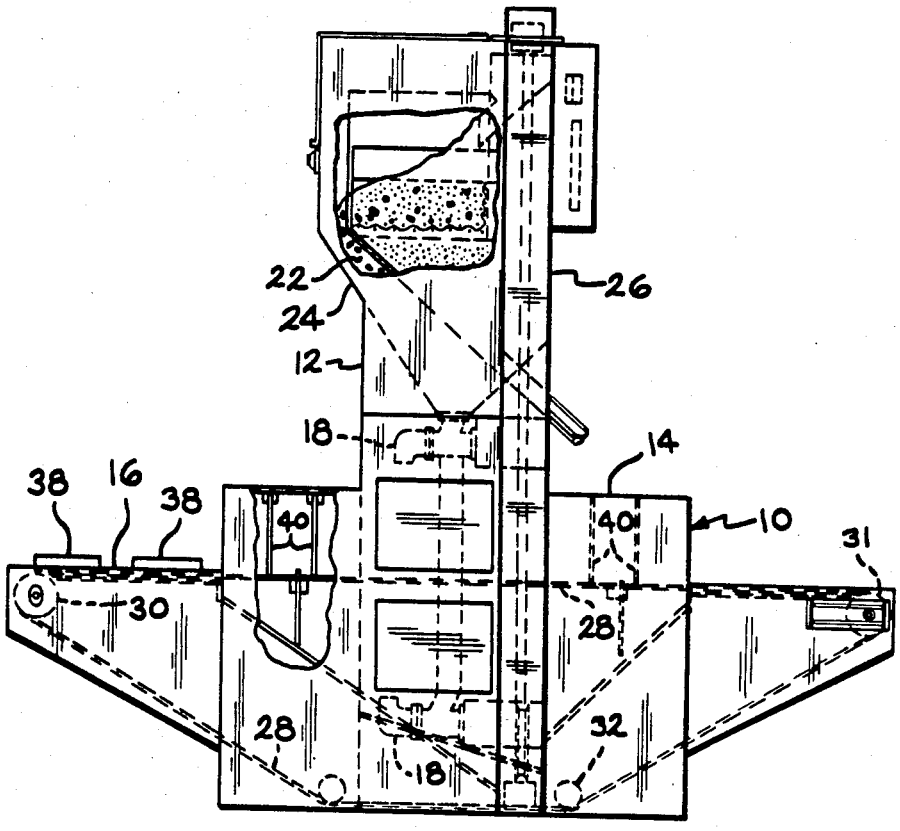
FIG. 2 is a reduced side elevational view of the apparatus of this invention, with some parts broken away for the purpose of clarity.

With reference to the drawing, the apparatus of this invention, indicated generally at 10, is shown in FIGS. 1 and 2 as including a main frame 12 on which is mounted a housing 14 and a conveyor assembly 16 which is operable to move sand cores to be cleaned through the housing 14. A plurality of nozzles 18 are mounted in the housing 14 at positions above the conveyor assembly 16 and a plurality of the same nozzles 18 mounted below the conveyor 16. The nozzles 18 are supplied with air by a blower or turbine 20 and a particalized media 22 is fed to the nozzles 18 from a supply hopper 24 located above the nozzles 18. An elevator assembly 26, of conventional type, operates to transfer used particles 22 from the bottom of the apparatus and deliver these particles to the hopper 24 for re-use.

The conveyor assembly 16 is illustrated as including a plurality of endless strands 28 (FIG. 1), similar to ropes or cables, trained about pulley or sheave assemblies 30, 31 and 32 mounted on the main frame 12. The pulley assembly 30 includes a shaft 34 which is driven by a motor drive assembly 36 so as to move the strands 28 that extend horizontally between the pulley assemblies 30 and 31 from left to right in FIG. 1. A plurality of sand cores to be finished, indicated diagrammatically at 38 in FIG. 2, are laid on the horizontal strands 28 and are moved by the strands into the housing 14 to positions between the upwardly and downwardly directed nozzles assemblies 18. During movement of the cores 38 into and out of the housing 14, they move through rubber curtains 40 which tend to confine the particles 22 from the nozzles 18 to the housing 14.

As shown in FIG. 3, each of the nozzles 18 consists of a nozzle head 42 rotatably mounted on an injector body 44 which is connected to a conduit 46 through which air is supplied from the blower 20 and a conduit 48 through which the particles 22 are supplied.

An inclined septum 47 directs the particles in conduit 48 toward the air stream emanating from conduit 46 at the lower edge 49 of the septum 47. Since the air stream in conduit 46 is created by the blower 20, in contrast to a compressor, it is at a low pressure, namely, below 2 psi. and in the range of 0.5 to 1.75 psi. Such a pressure is well below the pressures used in blast cleaning. As a result, in this invention, the airstream entrains large volumes of the particles 22 falling off the edge 49 in the form of a curtain. This forms a low pressure stream issuing from nozzle head 42 that contains a dense accumulation of particles 22 directed toward sand cores to be cleaned. The particles are then "breathed" against the sand cores to be cleaned rather than being accelerated or blasted against the cores. The process is thus more a matter of pneumatic conveying than it is air blasting. It is to be understood that the nozzle head 42 can be remote from the injector body 44 and be connected thereto by a suitable passage.

The result is a relatively soft flow of particles 22 from each nozzle head 42 that provides for a shower of the particles 22 on both the top and bottom sides of the cores 38 supported on the strands 28 in the housing 14. Particles that are as hard as conventional steel shot used for blast cleaning are too hard and cause erosion of a sand core. However, particles 22 formed of plastic and generally cylindrical in shape, as illustrated in FIG. 6, are preferred from the standpoints of effectiveness, cost, cleanliness and lack of surface erosion on the core. Such particles have a hardness of D60–D70 shore. The particles 22 are preferably formed of an easily obtained plastic, such as polyethylene or polycarbonate, and are relatively small in size, a preferred particle 22 being about 0.06 inch diameter and 0.06 inches in length.

A rough molded sand core 38 is shown in FIG. 4. The core is of a relatively complex shape having notches 50, openings 52, projections 54, and other irregularly shaped surfaces on which excess material, a mixture of sand and the binder, adhere as indicated at 56. These excess adhereing portions 56 are sometimes referred to as "flash" and must be removed from the main body 58 of the sand core 38 in order to make the core 38 useable for its intended purposes in a molding process.

As shown in FIG. 5, when the core 38 has been subjected to the action of the apparatus 10, all of the excess material 56 has been removed so that the core 38 can now be used without further processing. In the operation of the apparatus 10, the cores 38 are placed on the conveyor 16 as shown in FIG. 2 so that they travel on the conveyor 16 through the enclosure 14 and are subjected to the fluidized media 22 that is directed from both above and below onto the surfaces of the sand core 38. The open construction of the conveyor 16 enables thorough showering of the core 38 from both above and below. After the sand cores 38 emerge from the housing 14, they are readily useable in molding operations.

The air stream supplied to conduit 46 (FIG. 3) is supplied at a rate of about 200 CFM (cubic feet per minute) at a pressure in the range of 0.5–1.75 psi. so that the fluidized media is directed at the sand cores at a speed in the range of 65–110 feet per second. This amounts to "breathing" the particles onto the sand cores, as contrasted to blasting which involves higher pressures, so that the cores are gently cleaned without risk of structural damage or pitting.

From the above description, it is seen that the method and apparatus of this invention provides for the relatively gentle application of soft impact particles against the somewhat vulnerable body 58 of the sand core 38 so as to provide for the complete removal of all of the excess materials 56 on the body 48 without danger of damage to the body 58.

What is claimed is:

1. Apparatus for removing flash and other excess material from sand cores comprising at least one nozzle, blower means for supplying moving air at low pressure to said nozzle, a plurality of impact particles, feed means operable to deliver said impact particles into said moving air so as to form a stream of moving air from said nozzle containing said particles, said nozzle including an injector body attached to a first conduit communicating with said blower and a supply of air at about 200 CFM and a second conduit supplying said impact particles, and means associated with said injector body providing for a downwardly flowing curtain of said particles intercepted by a moving stream of air from said first conduit operable to entrain said particles therein, and a nozzle head communicating with said injector body and operable to direct said stream of air at a velocity in the range of 65–110 ft/sec and impact particles entrained therein toward said cores to be cleaned, said means providing said curtain of particles including a downwardly inclined septum extending from said second conduit into said first conduit and terminating in a free edge from which particles in said second conduit flow to form said curtain, and means providing for engagement of said sand cores by said stream, said particles being formed of a plastic material and being generally cylindrical in shape.

2. A method for removing flash and other excess material from sand cores comprising the steps of:

(a) providing a low pressure stream of moving air, (b) feeding a dense accumulation of impact particles into said stream, said particles being formed of a material with a hardness of D60–D70 shore, and (c) directing said stream of mixed air and particles at a velocity in the range of 65–110 ft/sec against said cores so as to dislodge flash and other excess material therefrom.

3. The method according to claim 2 wherein said particles are formed of a plastic material.

4. The method according to claim 3 wherein said impact particles are generally cylindrical in shape having diameters and lengths on the order of 0.06 inches.

* * * * *